United States Patent [19]

Meshulam et al.

[11] 4,064,626

[45] Dec. 27, 1977

[54] CUTTER FOR SHEET MATERIAL

[75] Inventors: Avram Meshulam, Edison, N.J.; Jerome I. Rebold, Timonium, Md.

[73] Assignee: CBS Inc., New York, N.Y.

[21] Appl. No.: 721,911

[22] Filed: Sept. 9, 1976

[51] Int. Cl.[2] ..... B26B 29/00

[52] U.S. Cl. ..... 30/287; 30/293; 30/294

[58] Field of Search ..... 30/287, 293, 294, 289, 30/286

[56] References Cited

U.S. PATENT DOCUMENTS

| | | | |
|---|---|---|---|
| 799,675 | 9/1905 | Ring | 30/293 |
| 886,750 | 5/1908 | White | 30/293 X |
| 1,343,269 | 6/1920 | Lees | 30/289 UX |
| 1,732,564 | 10/1929 | Mayer | 30/293 |
| 2,004,517 | 6/1935 | Homeier | 30/293 |
| 2,013,893 | 9/1935 | Matthews | 30/293 X |
| 2,690,805 | 10/1954 | Gransten | 30/294 |
| 2,924,010 | 2/1960 | Umholtz | 30/293 |
| 3,394,457 | 7/1968 | Holder | 30/294 |
| 3,787,971 | 1/1974 | Sutton et al. | 30/293 |
| 3,934,341 | 1/1976 | Carlson | 30/287 |

FOREIGN PATENT DOCUMENTS

| | | | |
|---|---|---|---|
| 68,020 | 9/1929 | Sweden | 30/293 |
| 4,233 | 2/1893 | United Kingdom | 30/289 |

*Primary Examiner*—James L. Jones, Jr.
*Assistant Examiner*—J. T. Zatarga
*Attorney, Agent, or Firm*—Spencer E. Olson

[57] ABSTRACT

A hand-held cutter for cutting sheet material, such as framing mats, which includes a body member of hemispheroidal shape, the diametral plane of which constitutes a flat bottom for moving over the sheet material. The body member has on the external surface thereof a pair of spaced-apart flat vertically oriented guiding surfaces between which are provided a pair of cutting blade-receiving slots, one disposed vertically and the other disposed at an angle with respect to the vertical. A cutting blade placed in either of the blade-receiving slots, after being adjusted to the desired cutting depth, is locked in position by a clamp which is actuated by a thumb-wheel which is largely contained within the body member.

8 Claims, 8 Drawing Figures

CUTTER FOR SHEET MATERIAL

BACKGROUND OF THE INVENTION

In mounting photographs, certificate and the like in a frame a mat made of cardboard or other suitable material is often used. In preparing such a mat it is necessary that the edges be trimmed precisely straight, and for the sake of appearance the inner edge of the mat is bevelled. Thus, it is desirable that the cutter be capable of cutting an edge that is perpendicular to the plane of the mat material and of also accurately cutting an edge bevelled at an appropriate angle. Cutting instruments heretofore available for this purpose have been cumbersome to use, relatively expensive to manufacture and difficult to adjust in the case of cutters having a capability of adjusting depth and angle of cut. Such a mat cutter is described in U.S. Pat. No. 2,924,010 and consists of a U-shaped body member having a smooth under surface which slides over the material to be cut. A shaft rotatably suspended between the two ends of the U have a slot therethrough which carries a cutting blade which projects downwardly to the surface of the work-piece. The shaft may be rotated to any desired angular position so as to establish a corresponding angle for the bevelled edge to be cut, and the blade may also be moved up or down to control the depth of cut. After the desired angular position and depth of the blade is selected the blade is tightened in the shaft, and the shaft locked to inhibit its rotation. The cutter is adapted to be guided along a straight edge by two guiding surfaces provided at the ends of the U. While the continuous adjustability of the angular position of the cutting blade might appear to be a desirable feature, the need for cutting bevelled edges at a variety of angles is rare, and the provision of this adjustability is not only costly but contributes to inconvenience in use as well as to a tendency for the cutting blade to shift from its pre-adjusted position during the cutting operation. The commercial implementation of the cutter described in this patent is formed of metal, and is thus unnecessarily heavy, and the upper surface of the body member is contoured to comfortably receive the heel and thumb of the right-hand of the user for moving the cutter along a straight edge; thus, it is very inconvenient for users who are left-handed.

SUMMARY OF THE INVENTION

It is, therefore, an object of the present invention to provide an improved cutting instrument for cutting vertical or bevelled edges on flat sheet material. A further object of the invention is to provide a small, relatively inexpensive cutter in which the cutting blade is securely locked in position, and is shaped to comfortably fit the hand of the user, be he right- or left-handed.

Briefly, the cutting instrument according to the invention includes a body member of generally hemispheroidal shape, the diametral plane of which provides a smooth under surface which slides over the work-piece. A pair of spaced-apart flat guiding surfaces are provided on the external surface of the body member, between which are provided a pair of spaced-apart cutting blade-receiving slots, one of which is disposed vertically and the other of which is disposed at an angle with respect to the vertical. These blade-receiving slots both intersect the flat under surface of the body member along a line parallel to and spaced inwardly from the guiding surfaces. A cutting blade is placed in the vertically disposed blade-receiving slot when it is desired to make a 90° cut, or on the angularly disposed blade-receiving surface when a bevelled cut is desired, and after the position of the blade on the body member is adjusted to give the desired cutting depth it is locked in place by a clamp located between the blade-receiving slots, the clamp being constructed and arranged to firmly secure the blade against the bottom of its blade-receiving slot regardless of which position is selected. The clamping member is secured to the body member by a single threaded bolt and is tightened and loosened by a thumb-wheel which is largely disposed within the guiding member. The described shape of the body member, and the essentially concealed thumb-wheel, provides a comfortable fit in the palm of the hand of the user, be he right- or left-handed.

BRIEF DESCRIPTION OF THE DRAWINGS

The above and other objects of the invention will be more readily apparent, and its construction and operation be more readily apparent, and its construction and operation better understood, from the following description in conjunction with the accompanying drawings, in which.

DESCRIPTION OF THE PREFERRED EMBODIMENT

Figure 4:
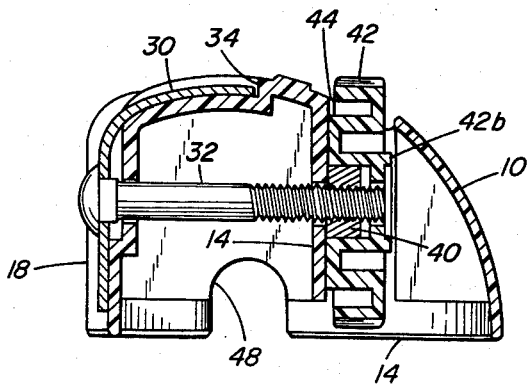
FIG. 4 is an elevational cross-section view taken along line 4—4 of FIG. 1.
Figure 3:
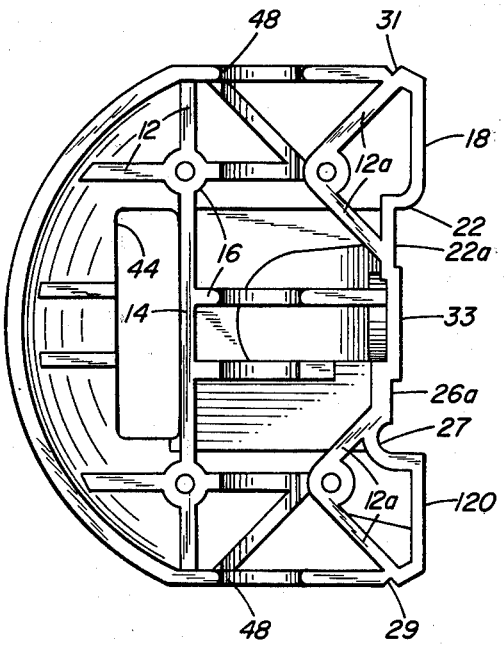
FIG. 3 is a bottom plan view of the body of the cutter.

As will be seen from FIGS. 1–4 of the drawings, the cutting instrument according to the invention includes a body member 10 which is of generally hemispheroidal shape and has a number of external surfaces formed thereon, the nature and purpose of which will be described presently. The body member is preferably molded from a lightweight, high-impact plastic material and, as best seen in FIGS. 3 and 4, is essentially hollow except for a plurality of internal ribs 12, **12*a*, 14 and 16 which are integrally joined to the outer wall and to each other to provide the necessary structural rigidity. The entire periphery of the underside of the body member, and the lower edges of the ribs 12*a* are disposed in a common plane, namely, the diametral plane of the hemispheroid, and together provide a smooth under surface 15 which is adapted to slide on the surface of a work-piece. The ribs 14 and 16 terminate short of the under surface 15, the rib 14 serving primarily as an abutment against which a blade-securing clamp is tightened, the ribs 16 giving the rib 14** the necessary rigidity.

The otherwise generally hemispheroidal body member 10 is truncated along a plane disposed perpendicularly to the under surface 15 to provide spaced-apart flat guiding surfaces 18 and 20 which are precisely aligned with each other so as to be adapted to engage a straight edge. Immediately adjacent the flat guiding surface 18 the body member is provided with a first blade-receiving slot 22, the bottom surface **22*a* of which is perpendicular to the under surface 15 and is of a width such as to snugly receive a cutting blade 24, such as a No. 19 mat blade distributed by X-ACTO. A second blade-receiving slot 26 is formed in the body member immediately adjacent the guiding surface 20, the bottom surface 26***a* of which is inclined at an angle with respect to the vertical, in this embodiment at an angle of 45°, and has a width substantially equal to the width of the slot 22. The inner side wall 26*b* of the slot is vertically oriented, and the other side wall 26*c* is inclined outwardly by approximately 30° to permit finger access to a blade resting on the bottom surface of the slot and to provide visibility of the lower extremity of the cutting blade when adjusting the cutting depth. The lower edge of both blade-receiving slots intersect the flat bottom of the body member along a line parallel to and spaced inwardly (by the depth of slot 22) from the guiding surfaces 18 and 20 whereby the cutting blade, whether vertically oriented for making a perpendicular cut or disposed at an angle to make a bevelled cut, cuts along a line displaced a predetermined distance from the guiding surfaces 18 and 20.

Figure 1:
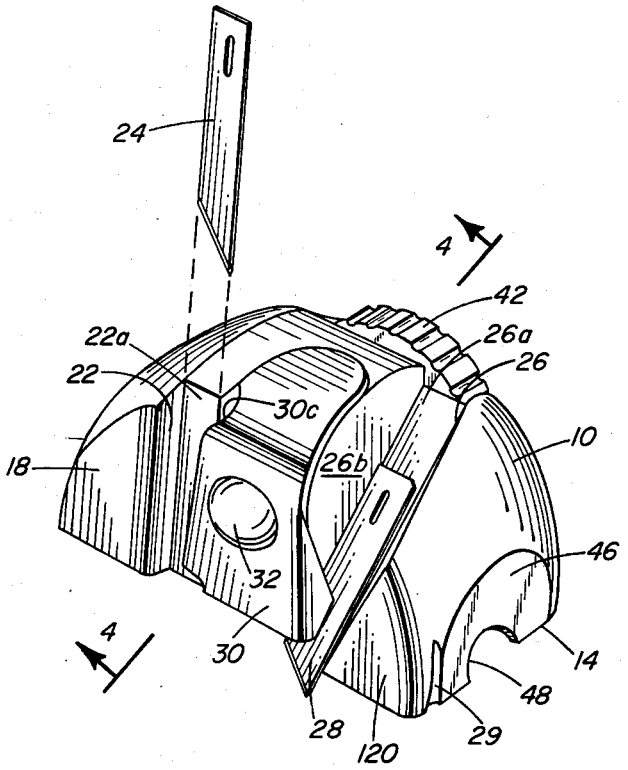
FIG. 1 is a perspective view of the cutting instrument according to the invention.
Figure 2:
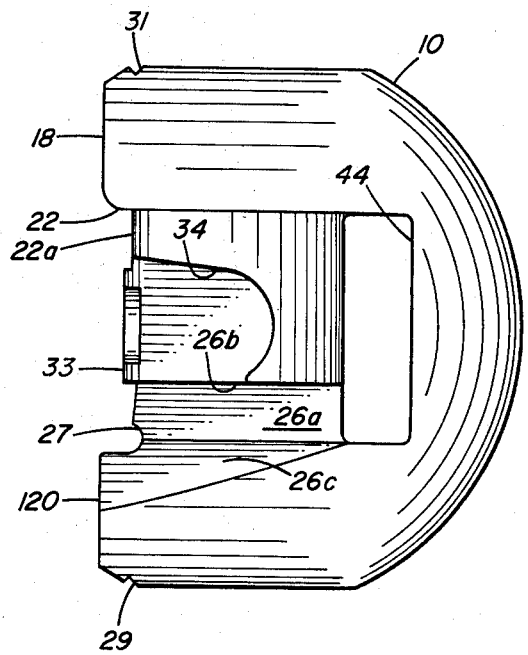
FIG. 2 is a top plan view of the body of the cutter.

A semicircular cutout 27 is provided at the intersection of bottom surface 26*a* and side surface 26*c* of slot 26 with the flat bottom of the body member to permit the surface of the sheet material being cut, which tends to be raised by passage of the inclined cutting blade as the cutter is moved from right to left as viewed in FIG. 1, to return to its flat condition before being engaged by the flat under surface of the body member. A pair of vertically oriented grooves 29 and 31 are formed in the external surface of the body member inwardly from guiding surfaces 20 ad 18, respectively, by a distance as to be aligned with the line of intersection of the slots 22 and 26 with the flat bottom, so as provide a readily visible index of the line along which a cut is to be made.

Figure 5:
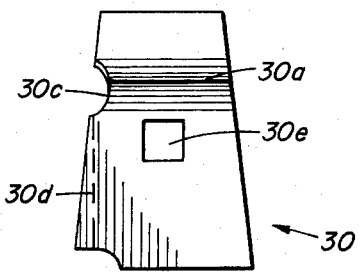
FIGS. 5, 5A and 5B are elevation, side and top plan views, respectively, of the blade-securing clamp of the cutter.
Figure 5A:
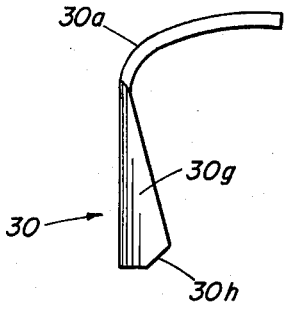
Figure 5B:
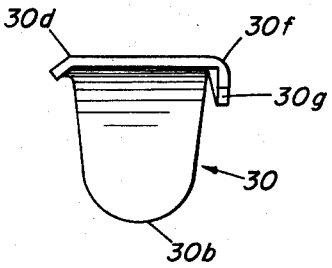

The cutting blade is positively locked in the selected slot by manually actuable clamping means which includes a clamping member 30 which is preferably formed of relatively rigid sheet metal stock. The clamp is secured to the body member, intermediate the two slots, by a threaded bolt 32 which extends into the body member 10 substantially parallel to the under surface 15. As best seen in FIGS. 5, 5A and 5B, in which it is shown full size, the clamp is formed of a single sheet of metal which has a generally trapezoidal shape over a portion of its length, which when assembled on the body member 10 is in contact with a vertically oriented external surface 33 formed on the body member between slots 22 and 26. The upper end of the clamp is curved at 30*a* to conform to th curvature of the body member and is contoured at its upper extremity 30*b* to be received in a similarly-shaped depression 34 formed in the upper curved surface of the body member. When assembled with the body member, the clamp extends over a portion of the width of both of slots 22 and 26, the cutout 30*c* being provided so as to clear a blade inserted in the vertical slot 22. The clamping member is bent inwardly at 30*d* to provide a tab 30*e* which is dimensioned to engage near its lower end a blade placed in the vertical slot 22 and to firmly lock it in place when the clamping member 30 is tightened against the body member. The other edge of the clamping member is bent inwardly somewhat more sharply at 30*f* and provides a tab 30*g* which lies between the vertical wall 26*b* and wall 26*c* of the slot 26, the lower end of the tab having an inclined surface 30*h* which is disposed at such an angle as to firmly engage the upper surface of a cutting blade 28 placed in slot 26.

The clamping member 30 is secured to the body member by a bolt 32 of the carriage type which extends through aligned openings in the front wall portion 33 and the rib 24, the square head of which is received in a square opening 30*k* in the clamping member. The threaded end of the bolt is engaged by a nut 40, preferably of hexagonal shape, which is placed within a correspondingly shaped opening in a thumb-wheel 42, which may also be formed of plastic. The periphery of the thumb-wheel is knurled or grooved to facilitate tightening and loosening of the nut. The thumb-wheel is disposed in a vertically oriented slot 44 formed in the curved surface of the body member 10 immediately adjacent the rib 14 which provides a bearing surface against which the wheel 42 may be tightened to thereby draw the clamping member 30 into firm engagement with the cutting blade. As will be seen in FIG. 4, the inner annular portion 42*a* of the wheel projects slightly outward from the outer annular surface 42*b* to prevent the rim of the wheel 42 from rubbing on the slot 44. The location of the bolt 32 and the diameter of the thumb-wheel 42 are such that only a relatively small portion of the thumb-wheel projects from the outer surface of the body member; that is, the thumb-wheel is largely contained within the body member so as to not interfere with the otherwise smooth and comfortable shape of the cutter yet is sufficiently exposed to facilitate convenient and easy manipulatin of the thumb-wheel.

In use, the thumb-wheel 42 is turned in one direction to release the clamp 30 sufficiently to allow a cutting blade to be inserted in one or the other of slots 22 and 26 beneath the clamping member, and after the blade is adjusted to the desired cutting depth, the thumb-wheel is turned in the other direction to draw the clamp into firm engagement with the confronting surface of the cutting blade and to lock it against the bottom surface of the slot. Because the slots are dimensioned in the width direction to snugly receive the blade, there is no tendency for the blade to move from its adjusted position during use despite the essentially point contact engagement of the clamping member with the cutting blade.

Figure 6:
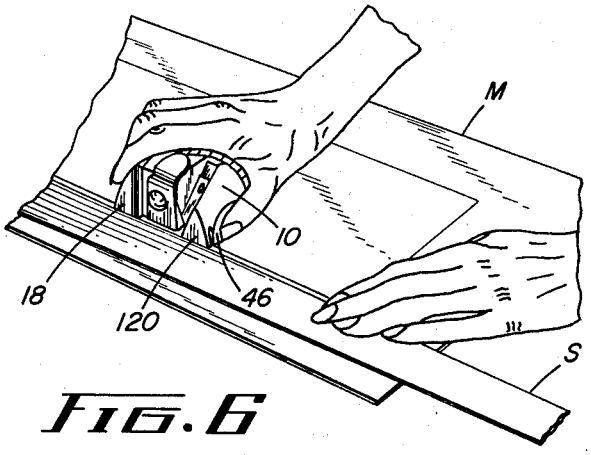
FIG. 6 is a perspective view illustrating the use of the cutter in trimming flat sheet material.

FIG. 6 illustrates how the cutting instrument is used to cut a flat sheet of material M. The movement of the cutter, shown being used by a right-handed user, is guided by sliding engagement of the guiding surfaces 18 and 20 displaced inwardly from the edge of the straight edge by the depth of the slot 22. Techniques for cutting mats being well-known, it is believed superfluous to here describe the complete operation in detail. FIG. 6, however, illustrates another feature of the cutting instrument which contributes to the comfort and ease of its use, namely, the vertically oriented flat surface 46, which is disposed in a plane perpendicular to the plane containing guiding surfaces 18 and 20, on which the thumb of the user may be rested while the hemispherical body member is engaged by the palm of the hand. A similarly disposed flat vertical surface (not visible in either of FIGS. 1 or 6) is provided on the other side of the body member for convenient engagement by the thumb of a left-handed user of a cutting instrument.

As an alternative to guiding the motion of the cutting instrument by sliding engagement of the surfaces 18 and 20 with a straight edge, provision is made for guiding it along a rod such as are provided on some drafting and work tables. To enable guiding of the cutter in this way, an archway 48 of generally semicircular shape is formed in the under surface 15, extending thereacross in a direction parallel to the guiding surfaces 18 and 20.

From the foregoing it can be ssen that there is provided a hand-held cutting instrument consisting of only five easily assembled parts, namely, the molded body member, the clamping member 30, the bolt, the nut and the thumbwheel, all of which are relatively inexpensive to manufacture. The construction is such as to positively lock a commercially available cutting blade in place, thus enabling the user to cut mats (or other material) either with a 90° edge or a 45° bevelled edge. The shape and size of the device (shown in full size in the drawing) are such as to comfortably fit the palm of the hand of either a left- or right-handed user. Although the inclined slot has been described as disposed at an angle of 45° with respect to the vertical, it will, of course, be understood that other angles of inclination may be used. It will also be understood that the cutter has uses other than for mat cutting, such as scoring and stripping, and that it can be used to cut balsa wood and plastic as well as cardboard.

We claim:

1. A cutting instrument adapted to slide upon the upwardly disposed flat surface of a work-piece in order to cut an edge thereon at a desired one of two predetermined angles, said instrument comprising:

a body member of generally hemispheroidal shape dimensioned to be comfortably grasped in the palm of the hand, the diametral plane of which constitutes a flat bottom for moving over the work-piece, said body portion having first and second external spaced-apart flat guiding surfaces disposed in a common vertical plane intersecting said flat bottom for guiding its movement parallel to a straight edge with which said guiding surfaces may be placed in contact, and having first and second parallel, spaced-apart, flat-bottomed cutting blade-receiving slots formed therein between said flat guiding surfaces, said first blade-receiving slot being disposed vertically with respect to the flat bottom with its bottom lying in a plane parallel to said common vertical plane and said second blade-receiving slot having its bottom inclined upwardly and inwardly at a predetermined angle from said common vertical plane, said first and second blade-receiving slots both intersecting said flat bottom along a common line parallel to and spaced inwardly from said guiding surfaces, a flat, elongated cutting blade having a cutting edge at one end thereof adapted to be snugly received in either of said first or second blade-receiving slots with its cutting edge extending beyond the flat bottom of said body member, and clamping means manually operable after a blade placed in a selected blade-receiving slot has been adjusted to the desired cutting depth for securing the cutting blade against the flat bottom of the selected blade-receiving slot.

2. A cutting instrument according to claim 1, wherein said clamping means comprises:

a clamping member supported on said body member between said first and second blade-receiving slots, said clamping member being formed of sheet material and having tabs thereon arranged to engage a cutting blade received in either of said blade-receiving slots at a point thereon near the line of intersection of the blade-receiving slot with said flat bottom, and means including a threaded member engaging said clamping member and extending into said body member and a nut threadably engaging said threaded member which when rotated in one direction forces said clamping member against said cutting blade.

3. A cutting instrument according to claim 2, wherein said threaded member is a bolt extending through said clamping member and into said body member in a direction substantially parallel to said flat bottom, and wherein said nut is engaged by and is adapted to be driven in rotation by a thumb-wheel contained within said body member except for a small peripheral portion.

4. A cutting instrument according to claim 2, wherein said body member is substantially hollow and is formed of high-impact plastic material, and said clamping member is formed of sheet metal and is shaped to substantially conform to the outer surface of said body member.

5. A cutting instrument according to claim 2, wherein the side wall of said second blade-receiving slot nearest said clamping member is disposed in a plane substantially perpendicular to said bottom and to said flat guiding surfaces, and the other side of said second slot is oriented at an angle such that the slot is wider at its top than at its bottom, and wherein said body member has a semicircular cutout at the intersection of the bottom and said other side of said second slot with said flat bottom of a size sufficient to permit the surface of a work-piece, raised by passage of the cutting blade, to return to its flat condition before being engaged by the body member.

6. A cutting instrument according to claim 1, wherein said body member has first and second external flat surfaces adapted to be engaged by the thumb of a user when the instrument is grasped in the palm of the hand, said external flat surfaces lying in parallel planes perpendicular to said bottom and to said guiding surfaces.

7. Cutting instrument according to claim 6, wherein said body member has first and second vertically oriented external notches disposed adjacent said first and second external flat surfaces, respectively, and aligned with the line of intersection of said blade-receiving slots with said bottom.

8. A cutting instrument according to claim 1, wherein said body member has an archway extending across the bottom thereof in a direction parallel to said guiding surfaces for receiving a guide rod for guiding its movement over a workpiece.

* * * * *